US005613824A

United States Patent [19]

Kato

[11] Patent Number: 5,613,824

[45] Date of Patent: Mar. 25, 1997

[54] AUTOMATIC BAG OPENING DEVICE

[75] Inventor: Fumio Kato, Handa, Japan

[73] Assignee: Tsukasa Industry Co., Ltd., Aichi, Japan

[21] Appl. No.: 536,699

[22] Filed: Sep. 29, 1995

[30] Foreign Application Priority Data

Mar. 23, 1995 [JP] Japan ..... 7-091472

[51] Int. Cl.[6] ..... B65B 69/00

[52] U.S. Cl. ..... 414/412; 222/87; 141/67; 141/114; 141/330

[58] Field of Search ..... 141/67, 114, 329, 141/330; 222/81, 82, 87, 202, 203, 630, 637; 414/411, 412

[56] References Cited

U.S. PATENT DOCUMENTS

| | | | |
|---|---|---|---|
| 2,031,869 | 2/1936 | Trouth | 414/412 |
| 3,599,682 | 8/1971 | Altmann | 222/81 X |
| 4,334,558 | 6/1982 | Durant | 141/114 |
| 4,527,716 | 7/1985 | Haas et al. | 414/412 X |
| 4,612,965 | 9/1986 | McGregor | 141/114 |
| 4,627,781 | 12/1986 | Borgner | 414/412 |
| 4,896,706 | 1/1990 | Tanner et al. | 141/114 |
| 5,056,980 | 10/1991 | Redl | 414/412 |
| 5,323,819 | 6/1994 | Shade | 141/67 X |
| 5,405,053 | 4/1995 | Zublin | 141/330 X |
| 5,535,791 | 7/1996 | Lisec | 141/114 X |

FOREIGN PATENT DOCUMENTS

| | | |
|---|---|---|
| 2533194 | 9/1982 | France . |
| 61-240729 | 10/1986 | Japan . |
| 61-236680 | 10/1986 | Japan . |
| 6040441 | 1/1992 | Japan . |
| 6-40441 | 1/1992 | Japan . |

*Primary Examiner*—J. Casimer Jacyna
*Attorney, Agent, or Firm*—Morrison Law Firm

[57] ABSTRACT

An automatic bag opening device includes a housing having a bag intake opening for receiving a filled shipping bag. A bag assist plate forms a chute, allowing the bag to slide down and rest on a bag rest. A hollow penetrator penetrates the bag to hold it in place while a bottom of the bag is cut. The bag rest moves away from the bottom of the bag, allowing the contents of the bag to spill out. An air blast through the penetrator helps the bag empty. Additional air blasts hit and shake the bag, knocking the contents loose. A bag pusher pushes the empty bag into a set of rollers, folding the empty bag in half, and discharging the bag outside the housing. A dust collector within the housing collects loose dust, thereby enhancing safety and cleanliness of the workplace.

6 Claims, 18 Drawing Sheets

AUTOMATIC BAG OPENING DEVICE

BACKGROUND OF THE INVENTION

This invention relates to an automatic bag opening device, and in particular, one that automatically opens and removes the contents of shipping bags.

Shipping bags contain various types of powdered or granular substances such as grain, flour, other foods, chemicals, and pharmaceutical powders or granules. A wide variety of substances are in powdered or granular form ranging from foodstuffs to industrial raw materials. Such substances include, for example, granular sugar, glucose, defatted powdered milk, starch, rice bran, spices, cement, fly ash, carbon black, salt, detergent, wheat, rice, corn, soybeans, malt, silica, aluminum oxide, titanium oxide, calcium carbonate, pulverized coal, lime, soda ash, food mix powders, wheat mix powders, soup powders, petrochemical powders, pharmaceuticals, cosmetics, blended fertilizers, phenol resin, polyethylene resin, ABC resin, PVC powder, polypropylene powder, and powdered or granular paints.

After being manufactured at a manufacturing facility, these substances are shipped to market in bags or plastic containers. Shipping is usually by ship, rail, or truck. Upon arrival at small or medium size plants, workers perform the operation of opening the bags and pouring their contents into a container, typically a hopper. Large scale plants and factories use automated equipment due to the volumes involved. In smaller plants, such operations are performed manually.

This manual operation requires heavy labor on the part of workers, especially when the bags are heavy. Workers are exposed to dust arising when the contents of the bags are poured out. If the substances are harmful or poisonous, the work environment is hazardous. For occupational safety, workers must wear a dust mask when opening the bags and pouring out any hazardous substances.

The work of opening and emptying bags creates a severe working environment involving heavy labor. The working environment is made worse by the need for workers to wear dust masks. In addition, the ill effects and psychological burden brought about by handling poisonous or virulent substances creates major problems in the workplace environment.

A bag opening device opens and empties bags of these various substances. Several types of bag opening device are already on the market. A brief description of typical examples of these conventional bag opening devices follows.

First, as the most general bag opening devices, devices such as an "automatic bag opening system, " "automatic bag opening device," "automatic bag opening equipment, " and "automatic bag opening machine" are on the market. These devices commonly have four functional mechanisms: (1) a mechanism to supply to the device bags filled with various powdered or granular substances, (2) a mechanism to feed the bags into the device, (3) a mechanism to open the bags and discharge their contents, and (4) a mechanism for processing the emptied bags. Since the four mechanisms are mounted on a large frame, the device is necessarily large, thus requiring a large area for its installation. It is difficult to install such devices in a small plant where space is at a premium.

An alternative device structurally different from the mechanism just described is a "bag opening hopper mechanism," which includes a fixed blade in a hopper over a vacuum device. Bags are suspended against the fixed blade which cuts a bag bottom to empty the bag's contents. However, variations in the weight and shape of the filled bags sometimes makes this device unusable, thereby limiting its range of application.

Unexamined Japanese Patent Application No. HEI6—40441 (1994), discloses a device intended to overcome these drawbacks in the prior art. The application discloses conveyance means for conveying the bags, a movable table for receiving the bags, means for standing the bags upright, an insertion tube having an air-blowing outlet, and a means for cutting the bag. The device maintains the interior of the bag at a positive pressure to remove the contents in a short time while leaving very little residue inside the bag.

However, a detailed analysis of this and the prior art previously described reveals the following unsolved problems.

First, the devices are far larger than they should be from the viewpoint of downsizing, which seeks to make the functions of the device as a whole integrated and compact, thereby reducing the installation space required. Second, the emptied bags are treated as trash waste products, with no thought given to recycling.

OBJECTS AND SUMMARY OF THE INVENTION

Accordingly, an object of the present invention is to overcome the drawbacks and limitations of the prior art.

Another object of the present invention is to provide an automatic bag opening device that combines compactness with efficiency, thereby reducing the required installation space.

A further object of the present invention is to provide an automatic bag opening device that achieves a clean workplace environment during operation.

A still further object of the present invention is to provide an automatic bag opening device which enhances recycling.

Briefly stated, an automatic bag opening device includes a housing having a bag intake opening for receiving a filled shipping bag. A bag assist plate forms a chute, allowing the bag to slide down and rest on a bag rest. A hollow penetrator penetrates the bag to hold it in place while a bottom of the bag is cut. The bag rest moves away from the bottom of the bag, allowing the contents of the bag to spill out. An air blast through the penetrator helps the bag empty. Additional air blasts hit and shake the bag, knocking the contents loose. A bag pusher pushes the empty bag into a set of rollers, folding the empty bag in half, and discharging the bag outside the housing. A dust collector within the housing collects loose dust, thereby enhancing safety and cleanliness of the workplace.

According to an embodiment of the invention, an automatic bag opening device for opening and emptying a bag of its contents includes a housing, a bag intake opening in the housing, a bag assist plate with first and second ends, the bag assist plate first end being rotatably mounted on a shaft connected to the housing, the bag assist plate second end rotating from an upright position to a chute position near the bag intake opening, an "L"-shaped bag rest having first and second portions, a first end of the first portion being rotatably mounted on a shaft connected to the housing, a second end of the first portion perpendicularly attached to a first end of the second portion, means for rotating the bag rest and the bag assist plate in tandem, whereby the second portion of the bag rest remains substantially perpendicular to the bag assist plate before, during, and after rotation, a hollow penetrator, a tip of the penetrator having an opening, means for extending and retracting the penetrator, means for blowing air through the tip of the penetrator, means, operative after the means for extending the penetrator, for cutting a bottom of the bag when the bag is on the bag rest and the bag assist plate is in the upright position, means for rotating the bag rest away from the bag bottom independently of the bag assist plate, means for striking the bag with at least one blast of air, thereby assisting the contents of the bag to fall out, a bag discharge opening in a wall of the housing, at least first and second rollers with a gap therebetween, the gap adjacent to the bag discharge opening, the rollers having at least one slit therein, means for blowing air through the slits, a bag pusher attached to the housing opposite the gap, and means for extending and retracting the bag pusher whereby an empty bag is pushed into the gap and discharged through the bag discharge opening.

According to an embodiment of the invention, an automatic bag opening device for opening and emptying a bag of its contents includes a housing, a bag intake opening in the housing, a bag assist plate with first and second ends, the bag assist plate first end being rotatably mounted on a shaft connected to the housing, the bag assist plate second end rotating from an upright position to a chute position near the bag intake opening, an "L"-shaped bag rest having first and second portions, a first end of the first portion being rotatably mounted on a shaft connected to the housing, a second end of the first portion perpendicularly attached to a first end of the second portion, means for rotating the bag rest and the bag assist plate in tandem, whereby the second portion of the bag rest remains substantially perpendicular to the bag assist plate before, during, and after rotation, a plurality of hollow penetrators, each of the penetrators having a tip with an opening therein, a plurality of recesses in the bag assist plate corresponding in number and position to a number and position of the penetrators, means for extending and retracting the penetrators into and out of the recesses, means for blowing air through the tips of the penetrators, means, operative after the means for extending the penetrators, for cutting a bottom of the bag when the bag is on the bag rest and the bag assist plate is in the upright position, means for rotating the bag rest away from the bag bottom independently of the bag assist plate, means for striking the bag with at least one blast of air, thereby assisting the contents of the bag to fall out, a bag discharge opening in a wall of the housing, at least first and second rollers with a gap therebetween, the gap adjacent to the bag discharge opening, the rollers having at least one slit therein, means for blowing air through the slits, a bag pusher attached to the housing opposite the gap, and means for extending and retracting the bag pusher whereby an empty bag is pushed into the gap and discharged through the bag discharge opening.

According to an embodiment of the invention, an automatic bag opening device for opening and emptying a bag of its contents includes a housing, a bag intake opening in the housing, a bag assist plate with first and second ends, the bag assist plate first end being rotatably mounted on a shaft connected to the housing, the bag assist plate second end rotating from an upright position to a chute position near the bag intake opening, an "L"-shaped bag rest having first and second portions, a first end of the first portion being rotatably mounted on a shaft connected to the housing, a second end of the first portion perpendicularly attached to a first end of the second portion, means for rotating the bag rest and the bag assist plate in tandem, whereby the second portion of the bag rest remains substantially perpendicular to the bag assist plate before, during, and after rotation, a bag suspension holding claw in the housing, means for moving the holding claw horizontally and vertically, means for opening and closing the holding claw, thereby permitting the bag to be held in a held state, means for cutting a bottom of the bag when the bag is in the held state, means for rotating the bag rest away from the bag bottom independently of the bag assist plate, means for striking the bag with at least one blast of air, thereby assisting the contents of the bag to fall out, a bag discharge opening in a wall of the housing, at least first and second rollers with a gap therebetween, the gap adjacent to the bag discharge opening, the rollers having at least one slit therein, means for blowing air through the slits, a bag pusher attached to the housing opposite the gap, and means for extending and retracting the bag pusher whereby an empty bag is pushed into the gap and discharged through the bag discharge opening.

The above, and other objects, features and advantages of the present invention will become apparent from the following description read in conjunction with the accompanying drawings, in which like reference numerals designate the same elements.

FIG. *5a* is a partial sectional top plan view according to an embodiment of the present invention.

FIG. *5b* is a partial sectional side elevation view according to an embodiment of the present invention.

Figure 1:
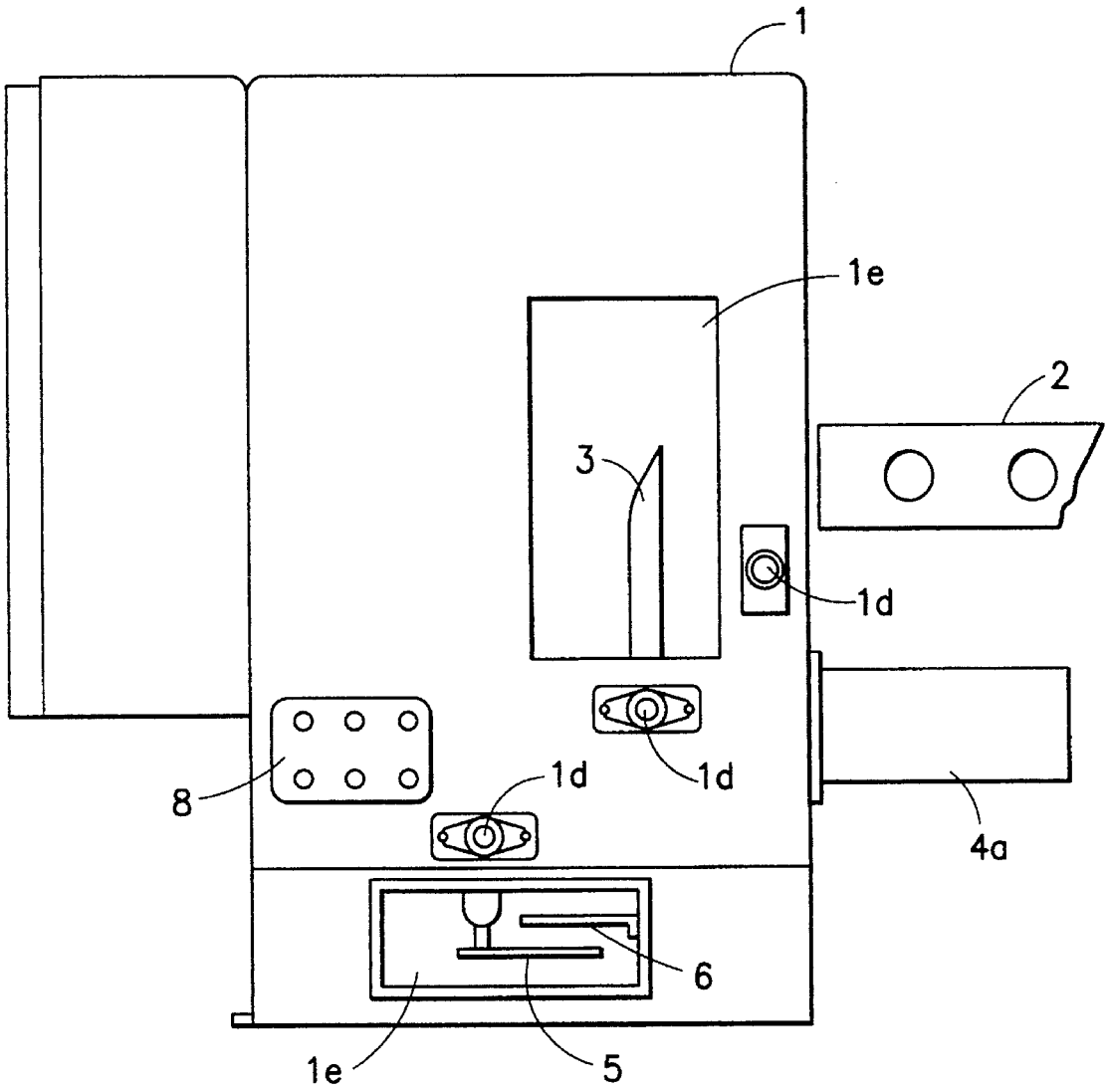
FIG. 1 is a front elevation view of an automatic bag opening device according to an embodiment of the present invention.
Figure 6:
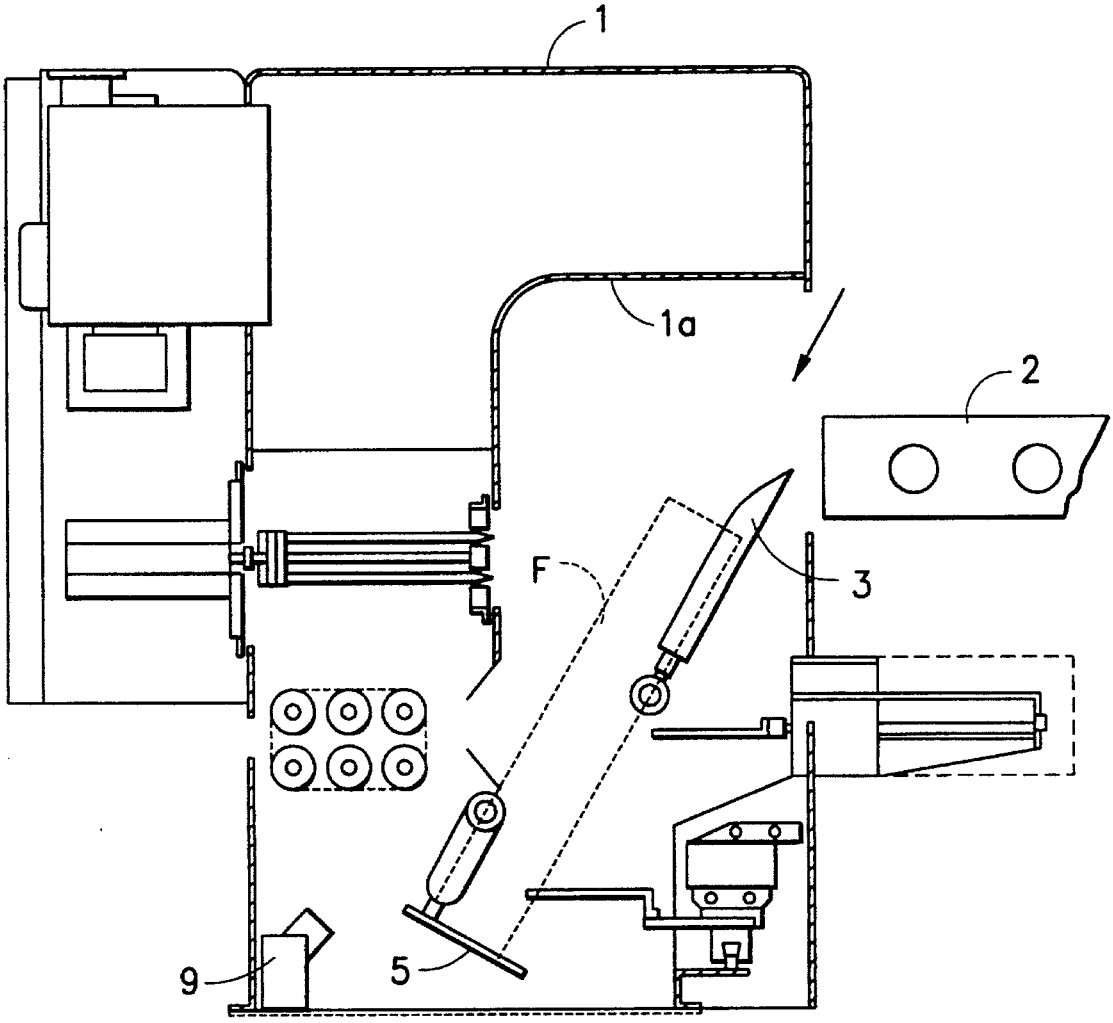

FIG. 6 is a partial sectional front view used in explaining the operation of the embodiment of FIG. 1.

Figure 7:
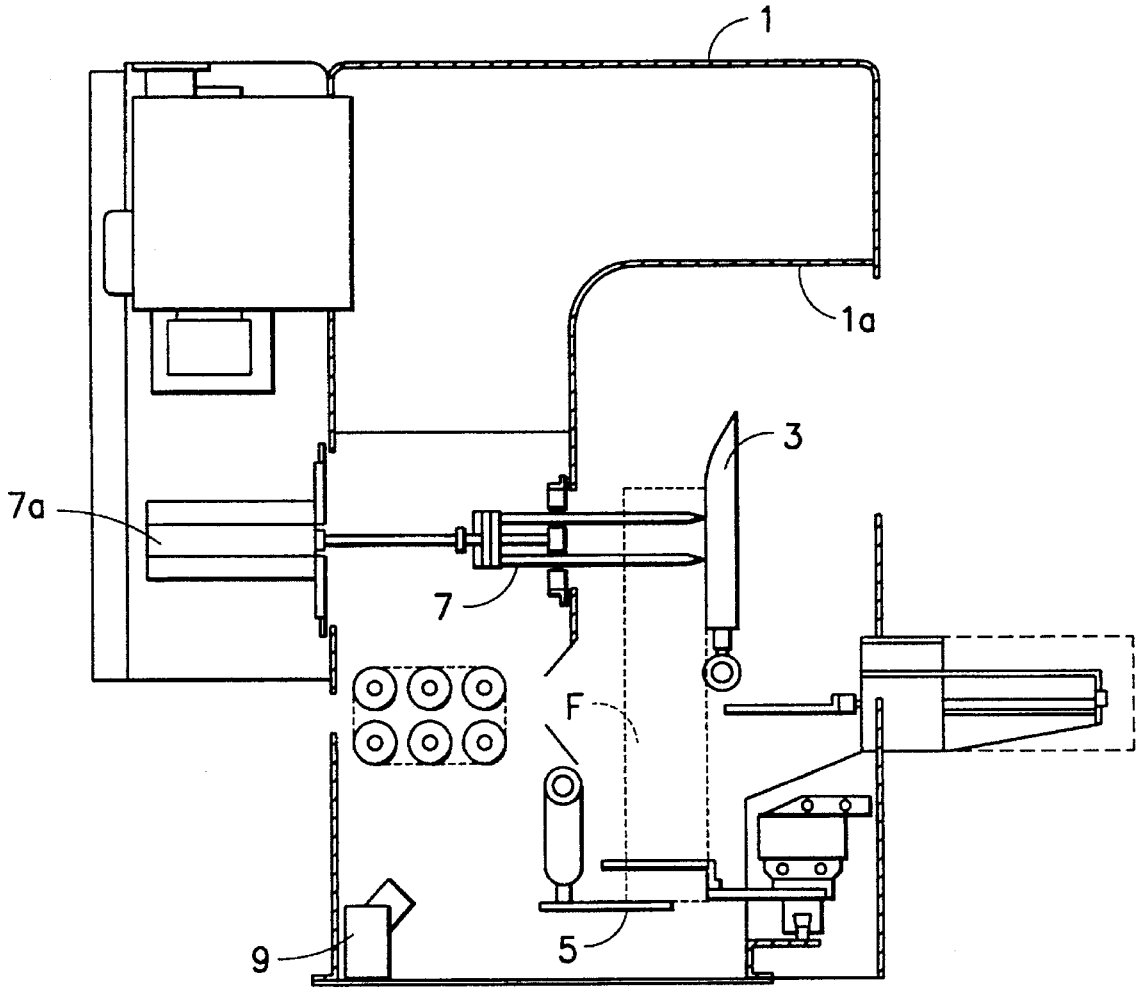

FIG. 7 is a partial sectional from view used in explaining the operation of the embodiment of FIG. 1.

Figure 8:
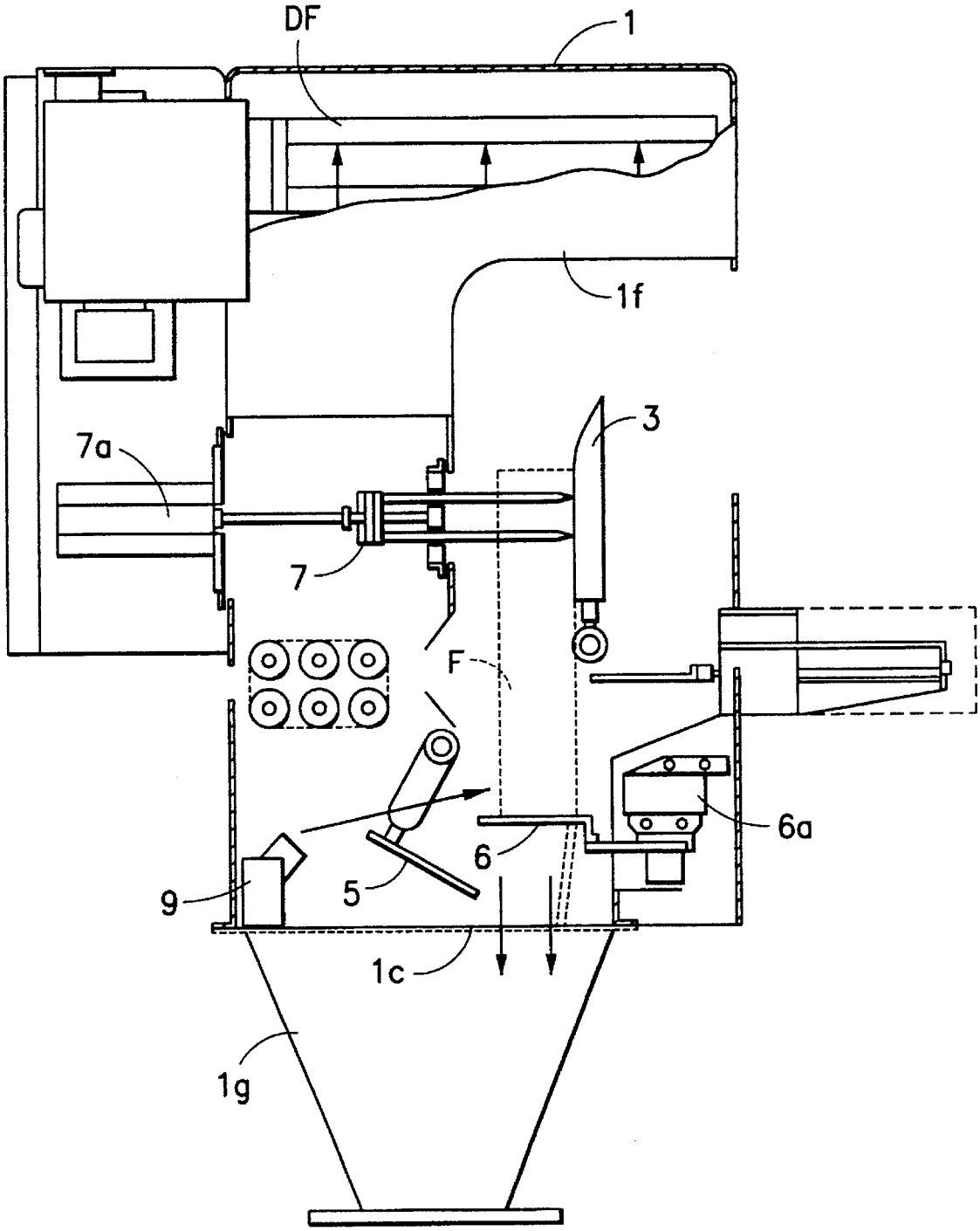

FIG. 8 is a partial sectional from view used in explaining the operation of the embodiment of FIG. 1.

FIG. *9a* is a partial sectional front view used in explaining the operation of the embodiment of FIG. 1.

FIG. *9b* is a side view of a roller assembly according to an embodiment of the present invention.

Figure 10:
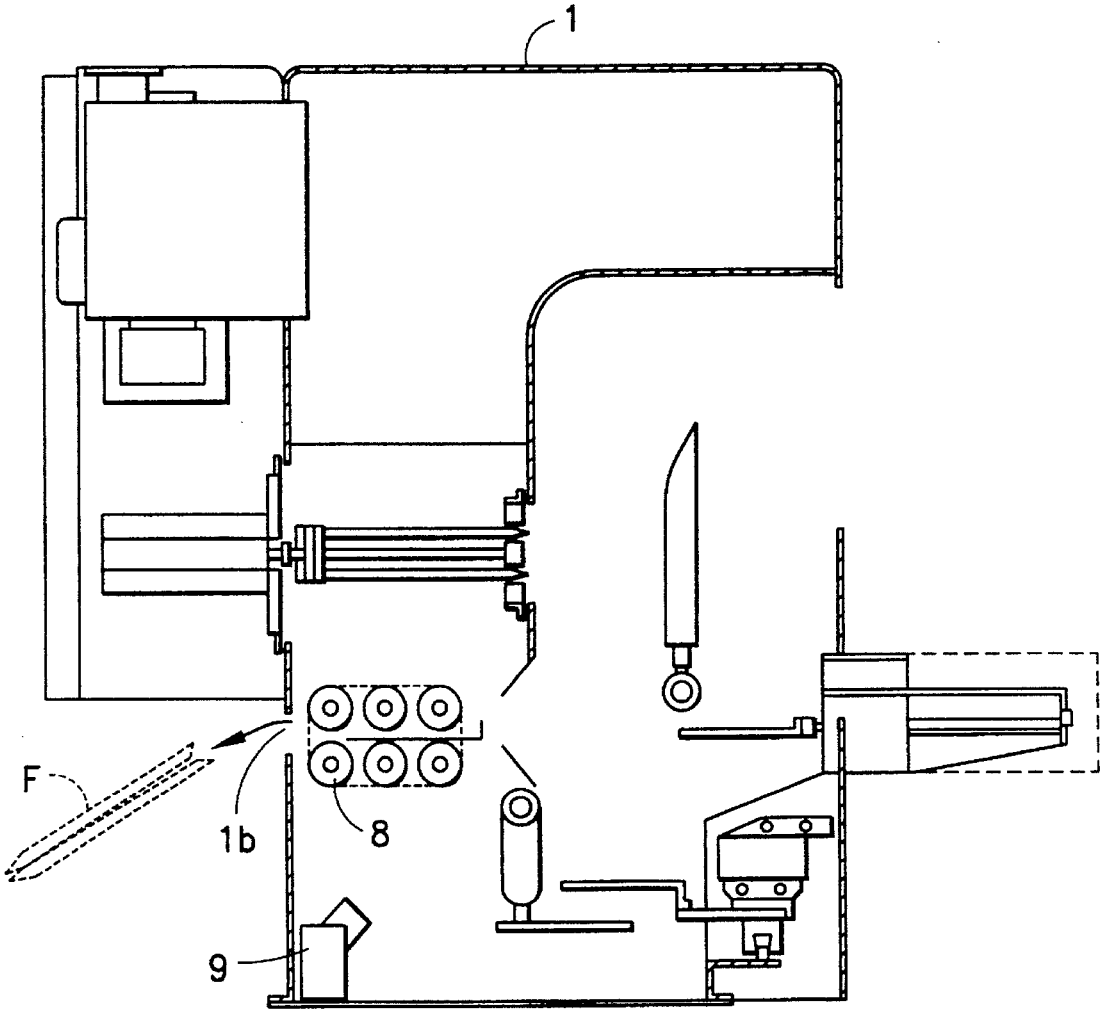

FIG. 10 is a partial sectional front view used in explaining the operation of the embodiment of FIG. 1.

Figure 11:
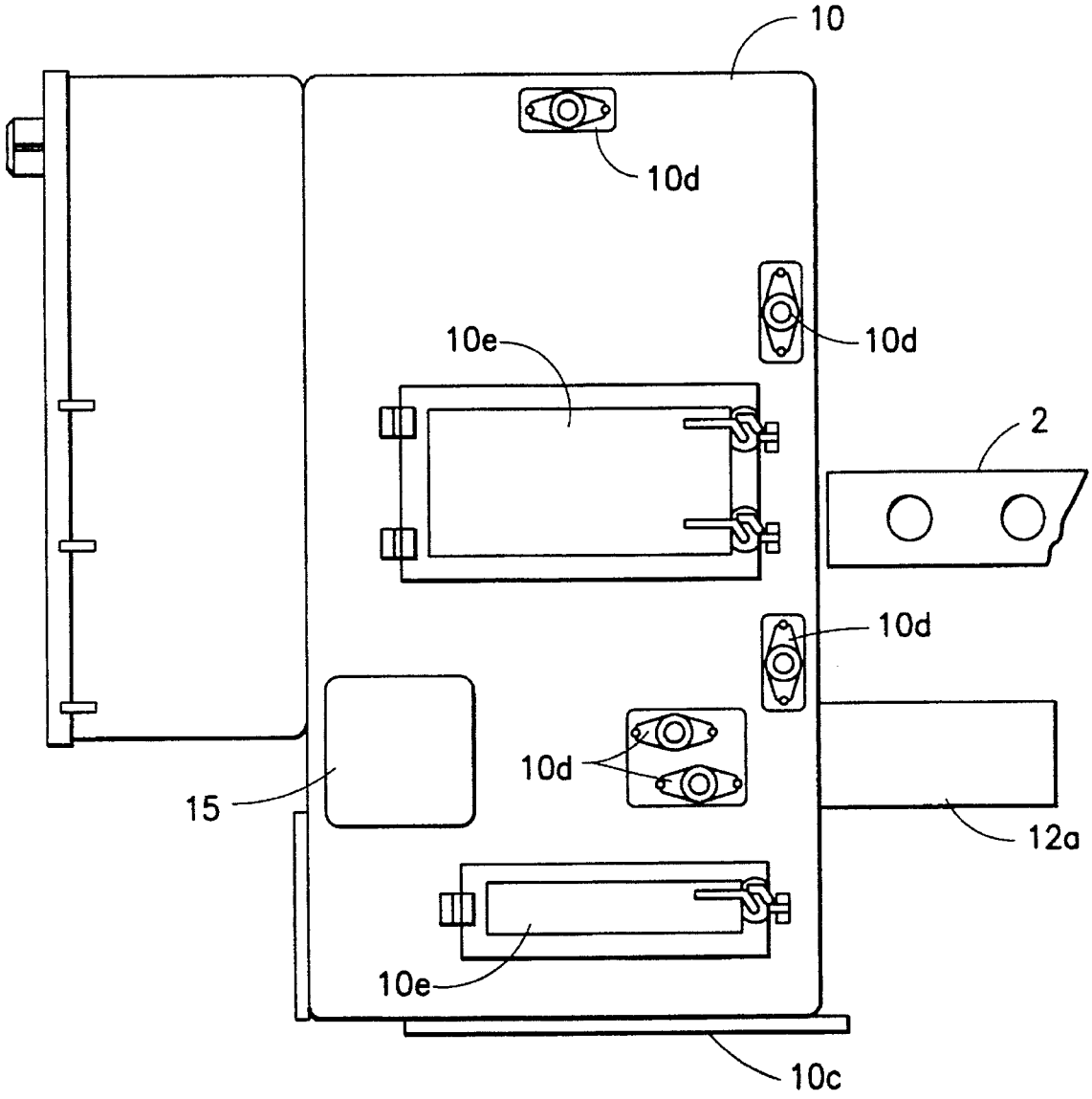

FIG. 11 is a front elevation view showing an automatic bag opening device according to a second embodiment of the present invention.

Figure 12:
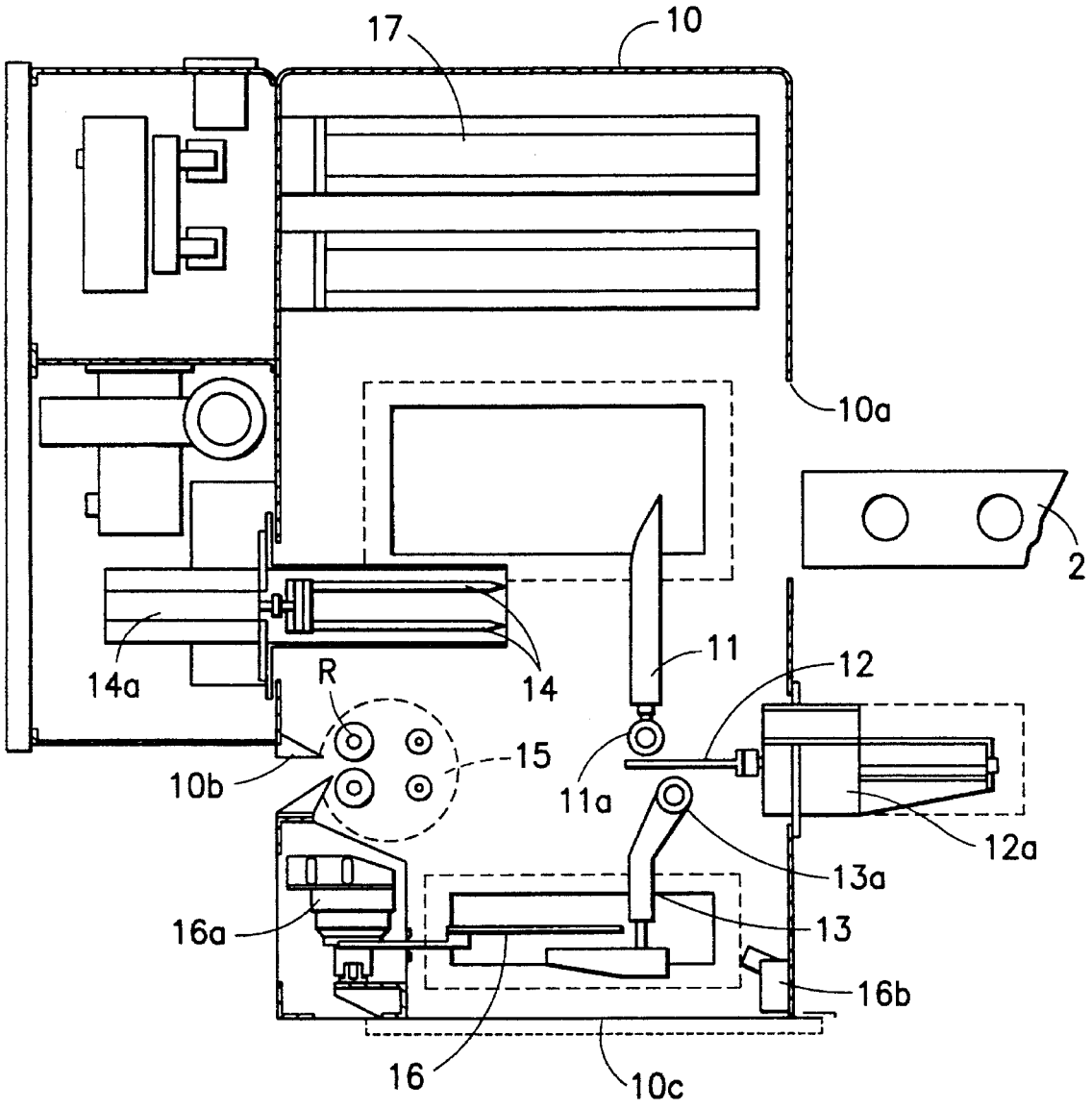

FIG. 12 is a partial sectional front view used in explaining the operation of the embodiment of FIG. 11.

Figure 13:
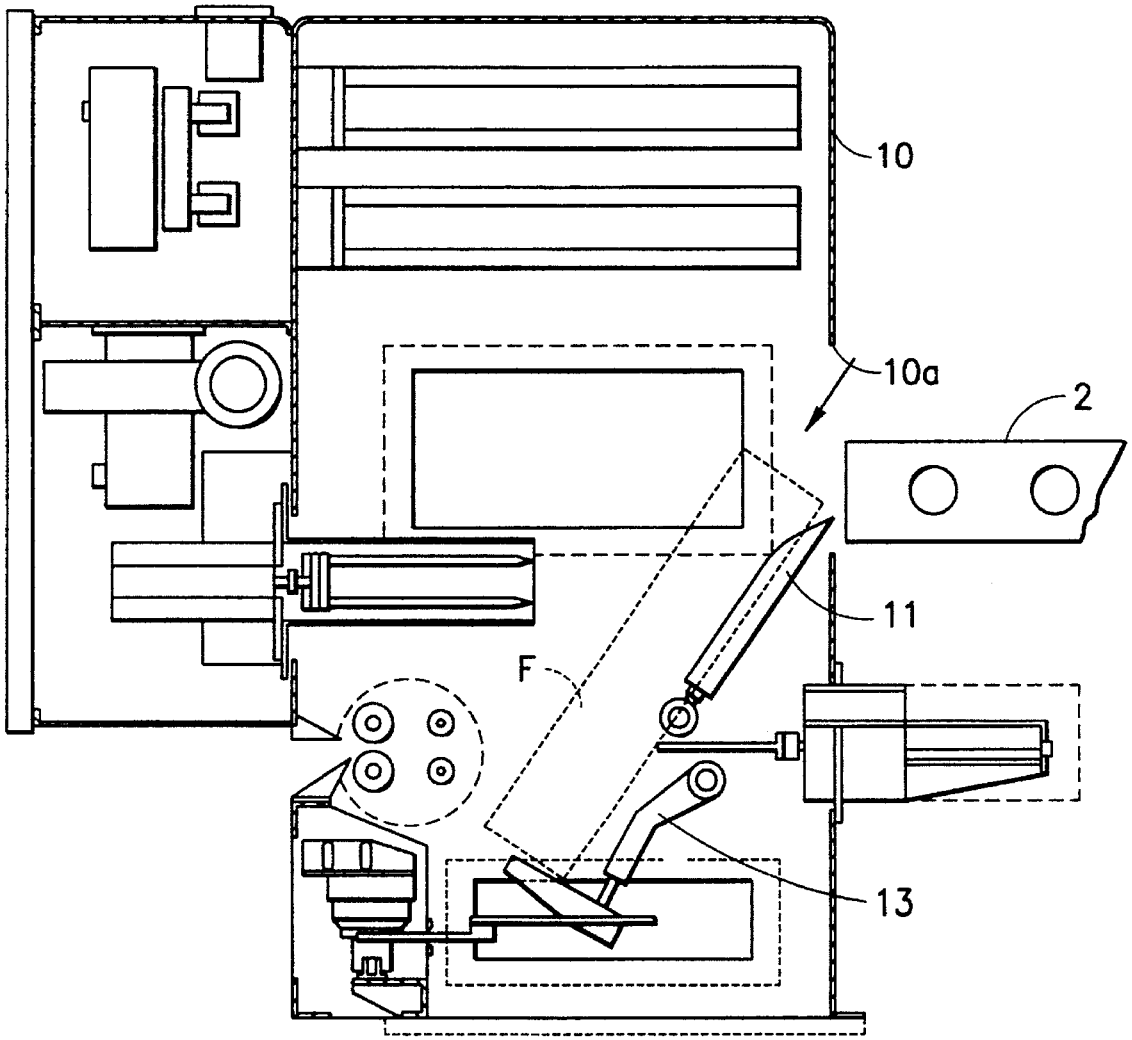

FIG. 13 is a partial sectional front view used in explaining the operation of the embodiment of FIG. 11.

Figure 14:
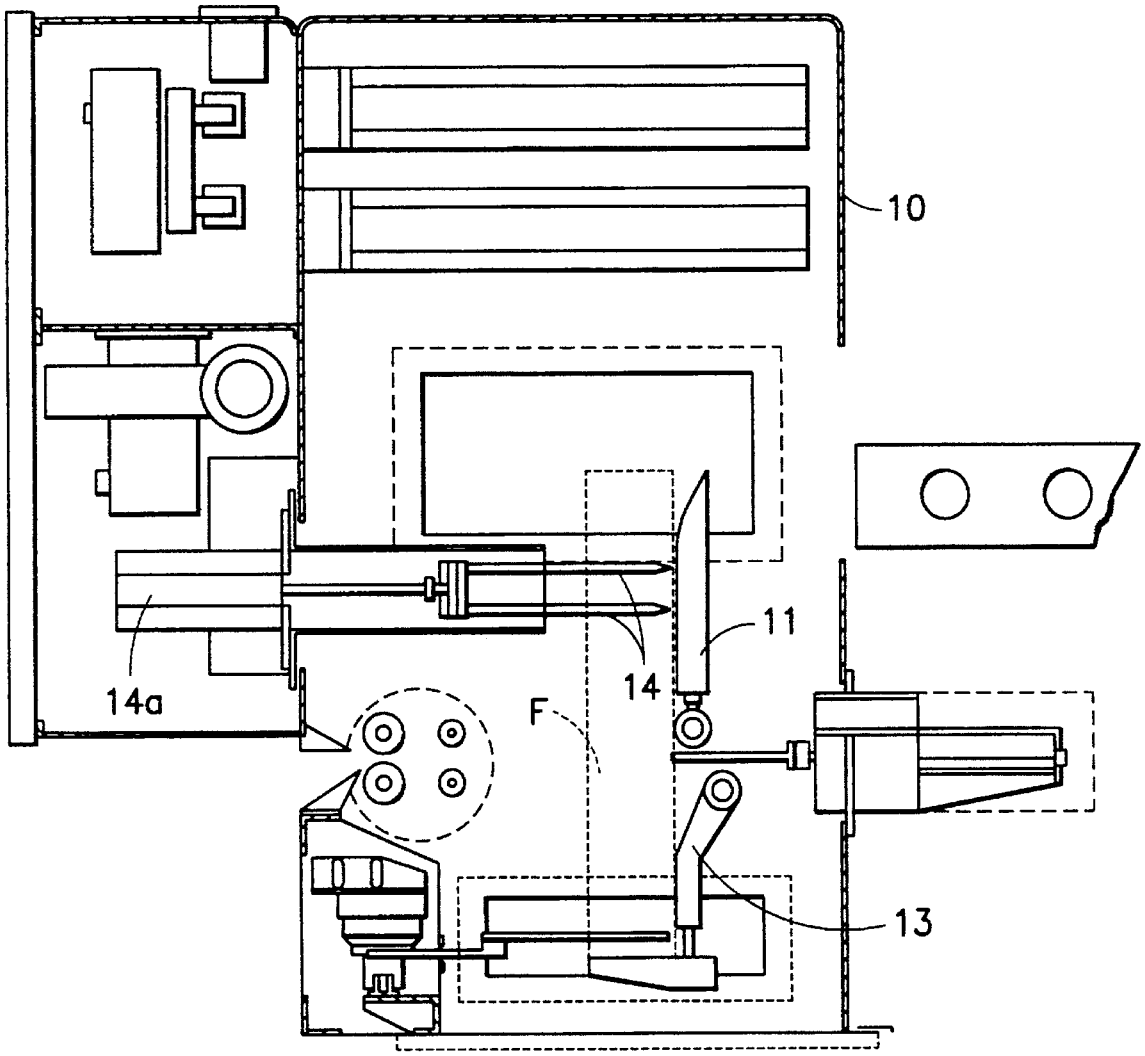

FIG. 14 is a partial sectional front view used in explaining the operation of the embodiment of FIG. 11.

Figure 15:
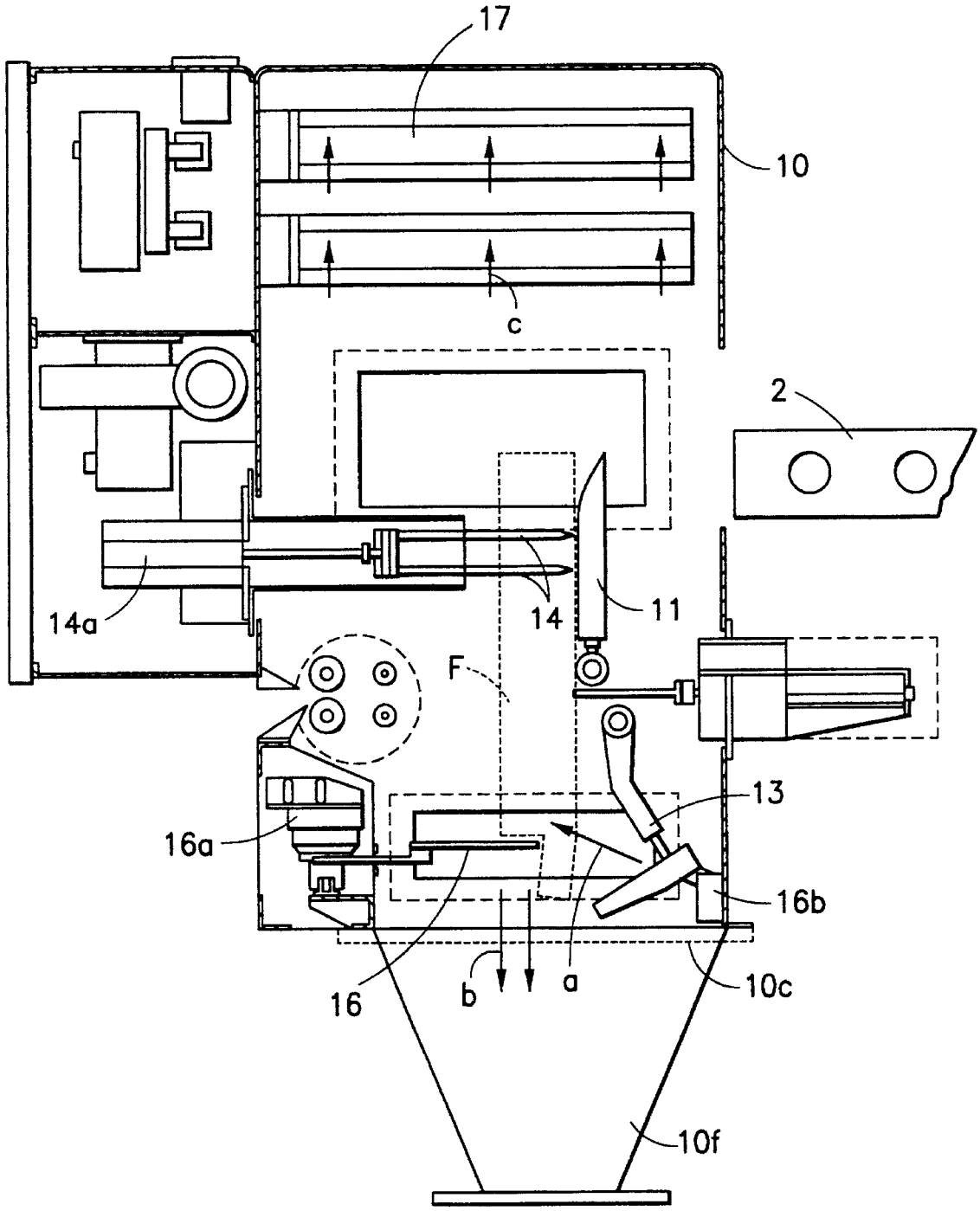

FIG. 15 is a partial sectional front view used in explaining the operation of the embodiment of FIG. 11.

FIG. *16a* is a partial sectional front view used in explaining the operation of the embodiment of FIG. 11.

Figure 16A:
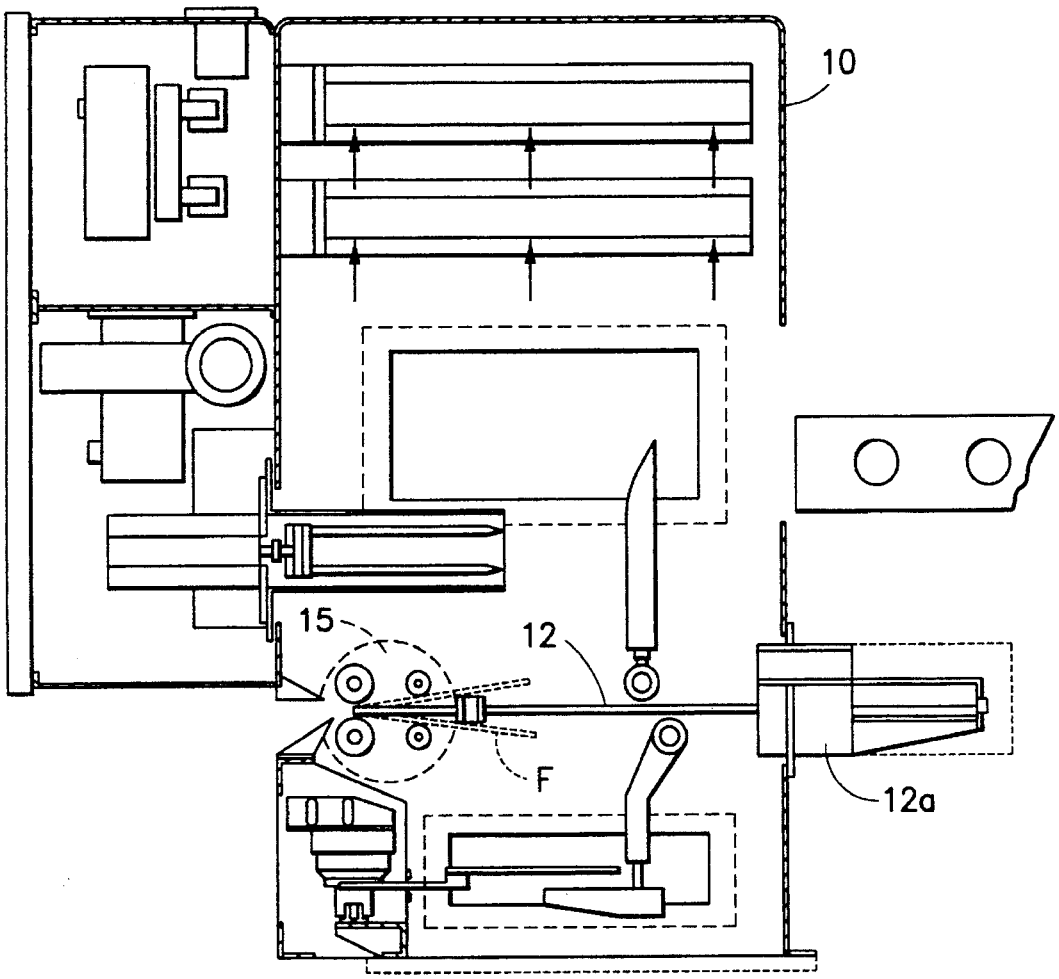
Figure 16B:
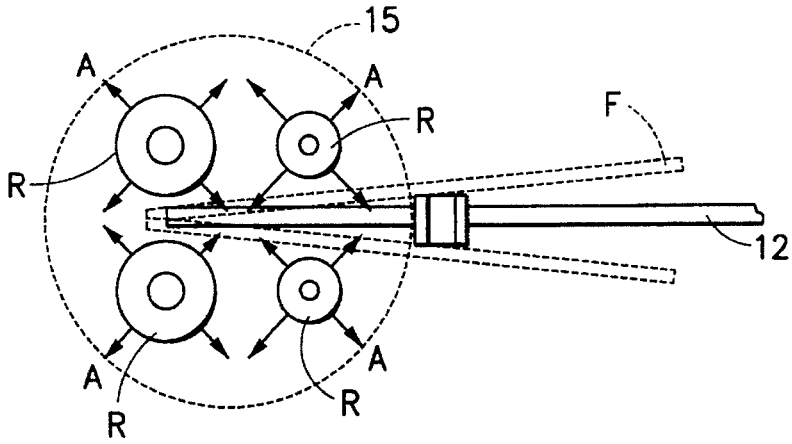

FIG. 16*b* is side view of a roller assembly according to an embodiment of the present invention.

Figure 17:
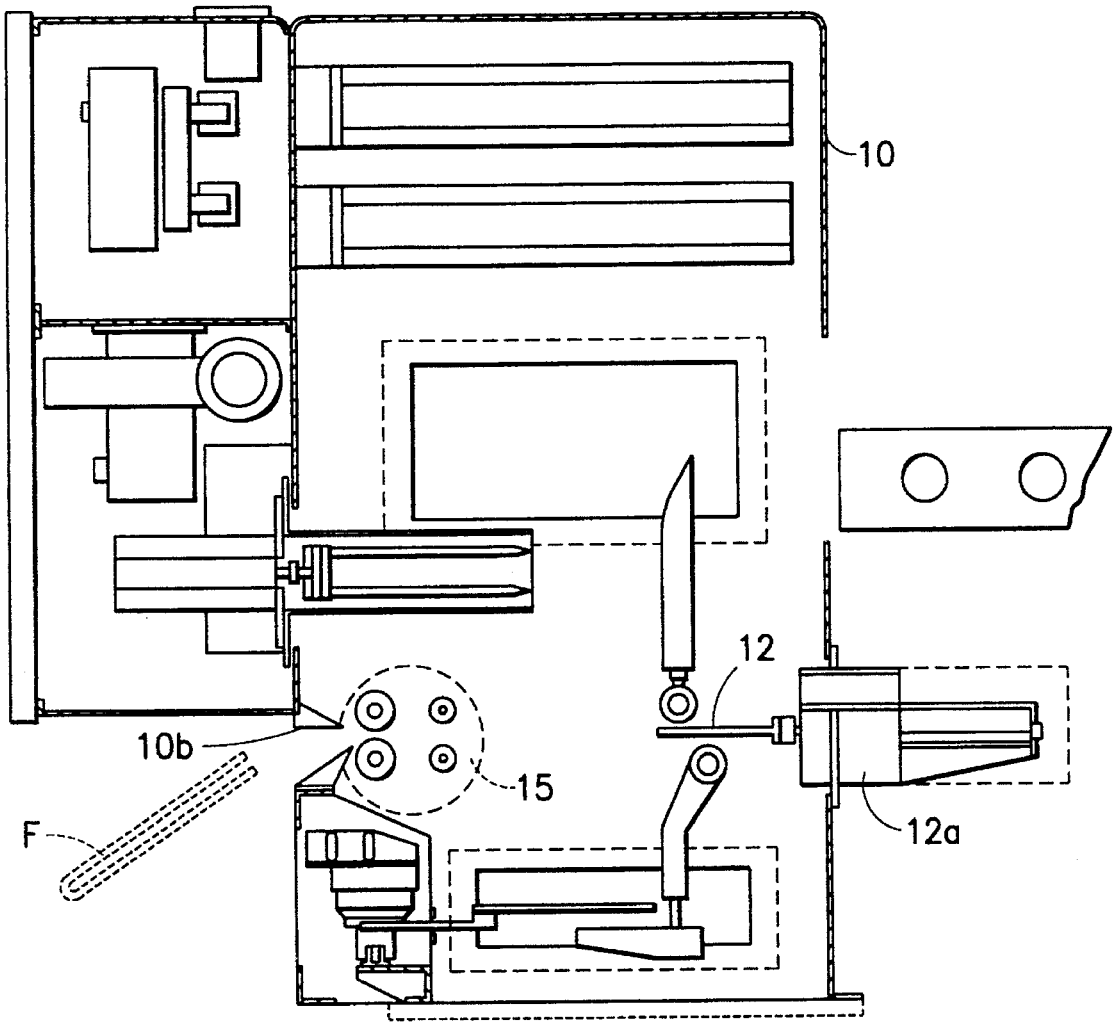

FIG. 17 is a partial sectional front view used in explaining the operation of the embodiment of FIG. 11.

Figure 18:
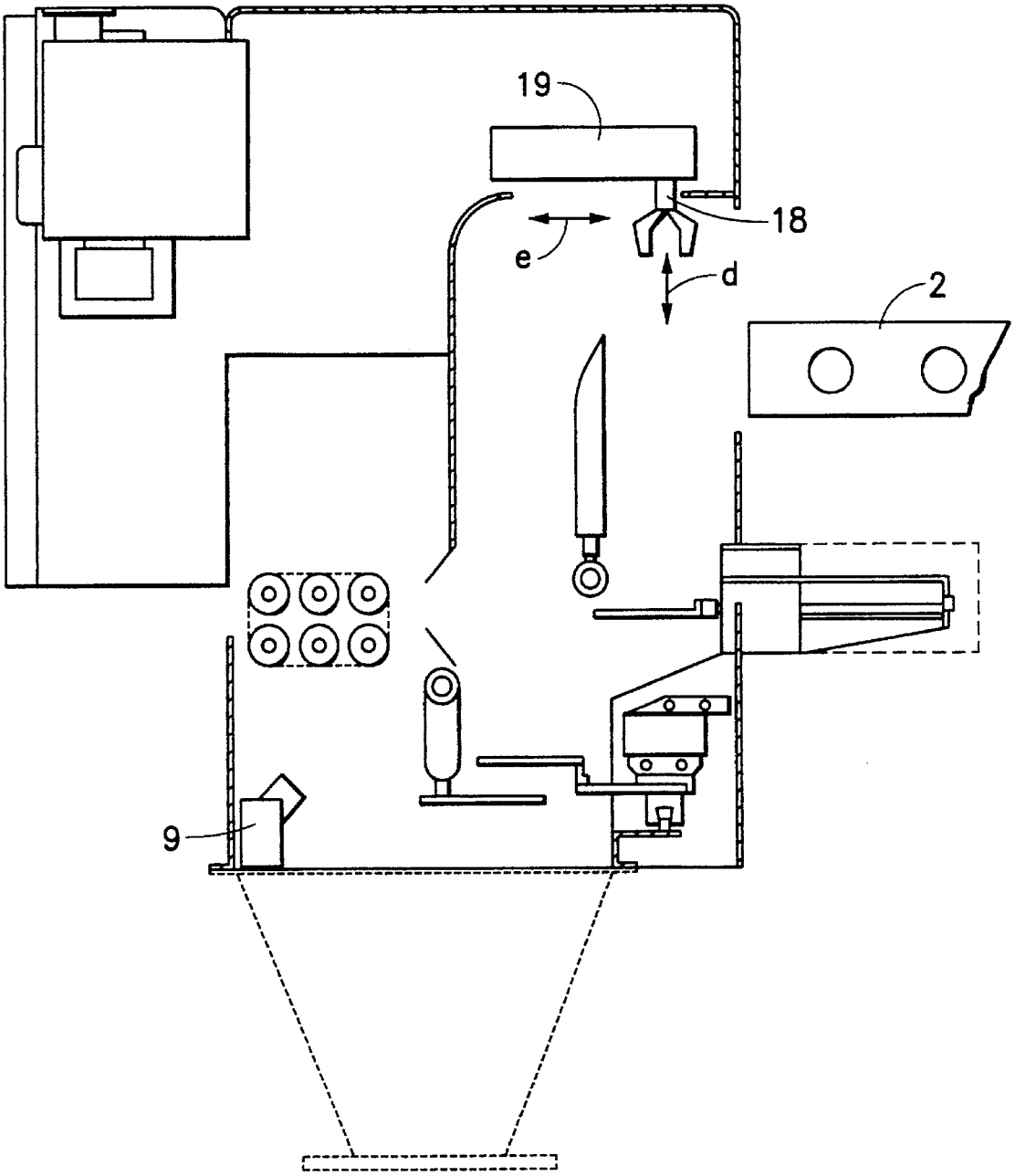

FIG. 18 is a partial sectional front view used in explaining the operation of an alternative embodiment of the present invention.

Figure 19:
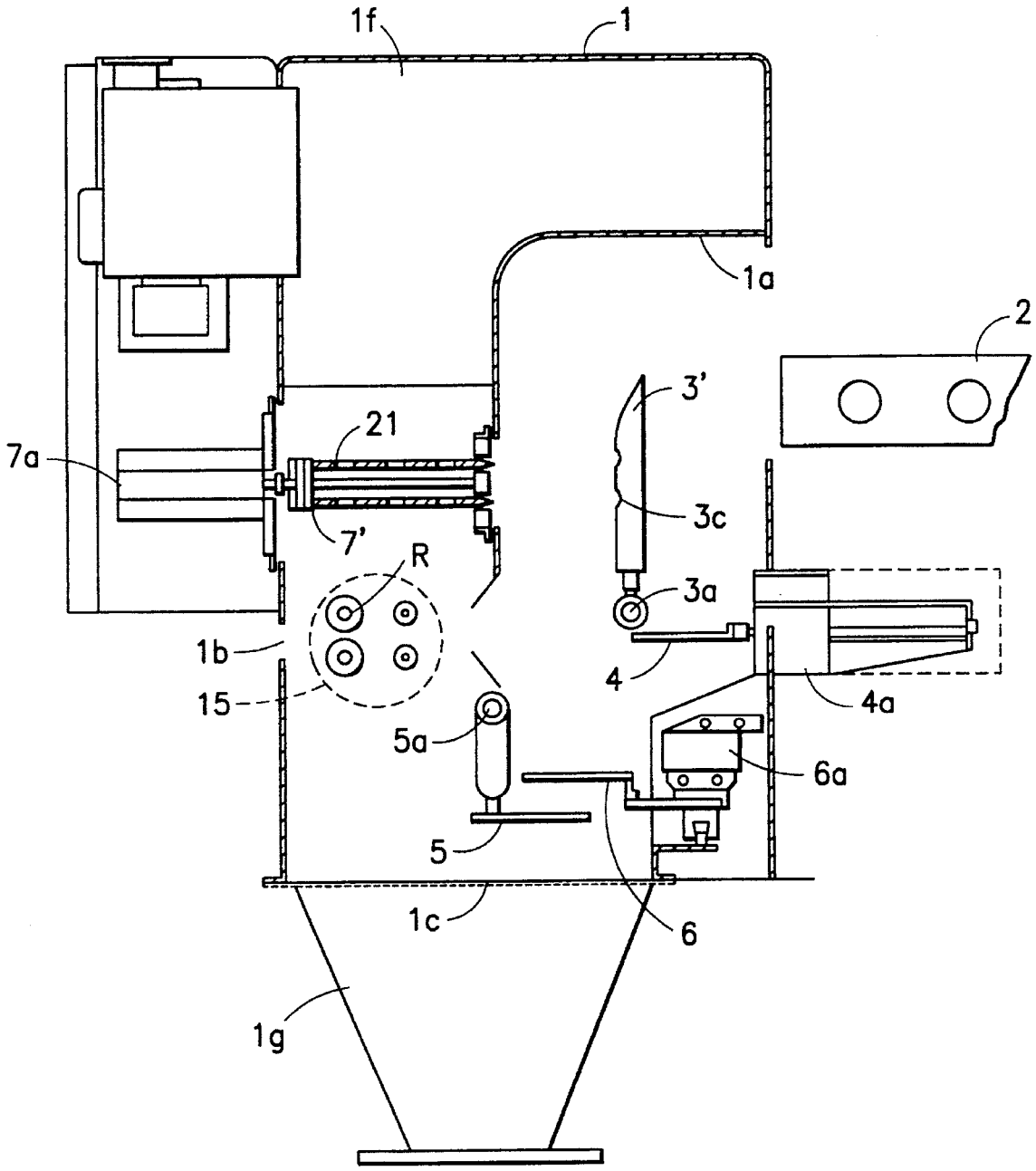

FIG. 19 is a partial sectional from view according to a third embodiment of the present invention.

DETAILED DESCRIPTION OF THE PREFERRED EMBODIMENT

Figure 2:
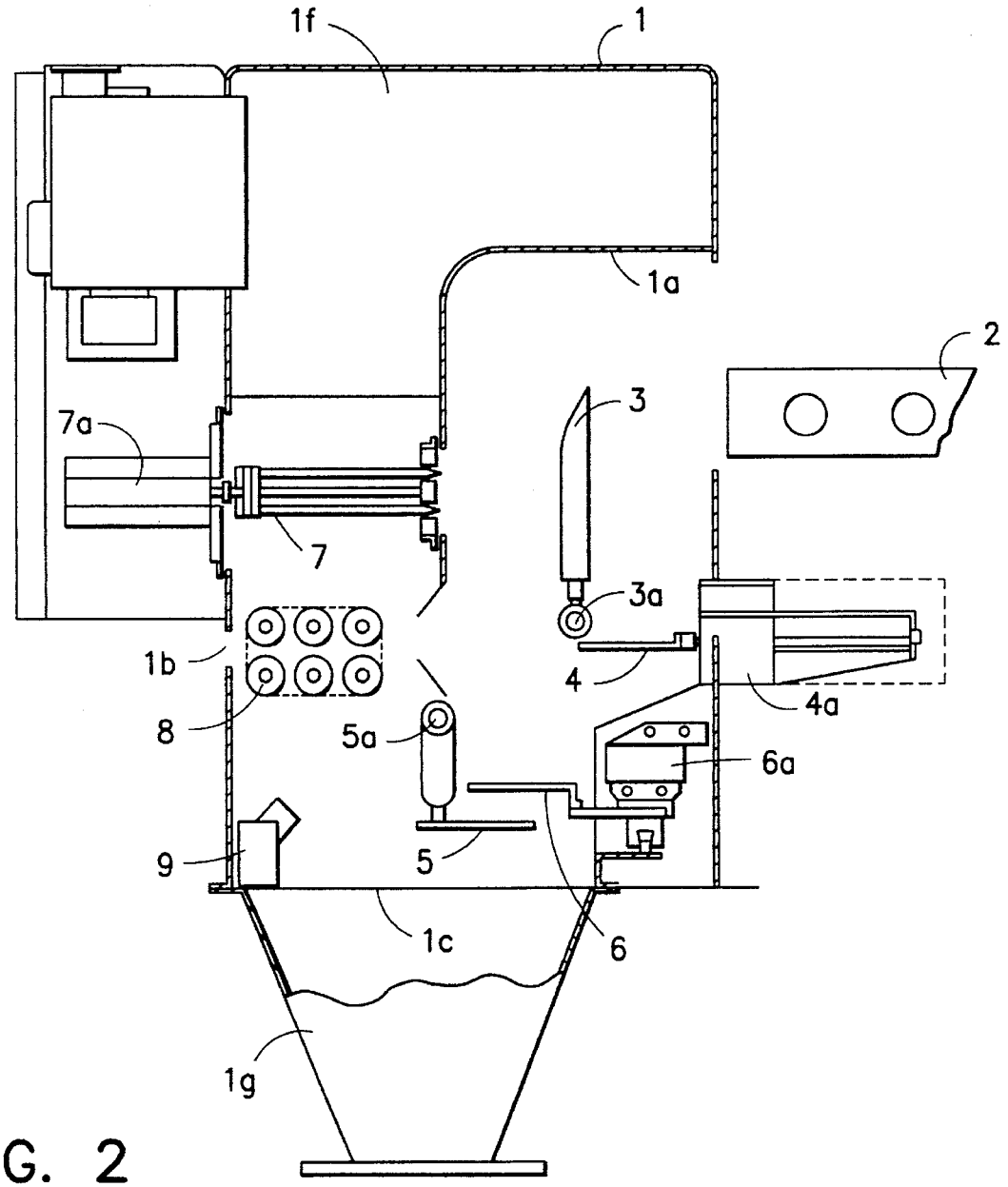
FIG. 2 is a partial sectional front view of the embodiment of FIG. 1.

Referring to FIGS. 1–2 and 6, a first embodiment of an automatic bag opening device includes a housing 1. A transport conveyor 2, adjacent to a bag intake opening 1*a* in housing 1, conveys a bag F filled with a powdered or granular substance to the device. A bag assist plate 3, rotatably mounted on a drive shall 3*a*, rotates from the vertical toward conveyor 2 to form a chute for bag F. A bag rest 5, rotatably mounted on a drive shaft 5*a*, rotates in tandem with bag assist plate 3 so that a top surface of bag rest 5 is perpendicular to a surface of bag assist plate 3. Drive shaft 3*a* and drive shaft 5*a* are each affixed to housing 1 by a bearing 1*d*.

As bag F enters housing 1, a control circuit (not shown) actuates drive shaft 3*a* and drive shaft 5*a*, tilting bag assist plate 3 and bag rest 5 to receive bag F. As a center of gravity of bag F crosses an end of conveyor 2, the weight of bag F forward of the center of gravity causes bag F to rotate onto bag assist plate 3. Bag F slides down bag assist plate 3 to rest on bag rest 5.

When the control circuit detects that bag F is securely held by bag assist plate 3 and bag rest 5, it returns bag assist plate 3 and bag rest 5 to their upright position. Bag F is thus vertically positioned on bag rest 5 with a back side of bag F in contact with bag assist plate 3.

Referring also to FIG. 7–8, a penetrator 7, opposite a front side of bag F, is driven by a penetrator drive actuator 7*a*. Penetrator 7 is a hollow tube with a sharp tip. When the control circuit detects that bag F is vertically positioned, the control circuit signals penetrator drive actuator 7*a* to cause penetrator 7 to penetrate bag F. A bag cutter 6, driven by a cutter drive actuator 6*a*, slices a bottom of bag F laterally just above bag rest 5. The control circuit then rotates bag rest 5 clockwise away from the bottom of bag F, allowing the contents of the bag to spill out while bag F is suspended from penetrator 7. At the same time, high pressure air is injected through penetrator 7 into an upper portion of bag F. The injected air blows the contents of bag F into a chute connection opening 1*c* leading to a chute 1*g* or hopper (not shown). An air nozzle 9 in a lower corner of housing 1 under rollers 8 directs pulses of air onto the outside of bag F to shake bag F and help remove its contents. At least one inspection window 1*e* permits an operator to view the operation.

Figure 9A:
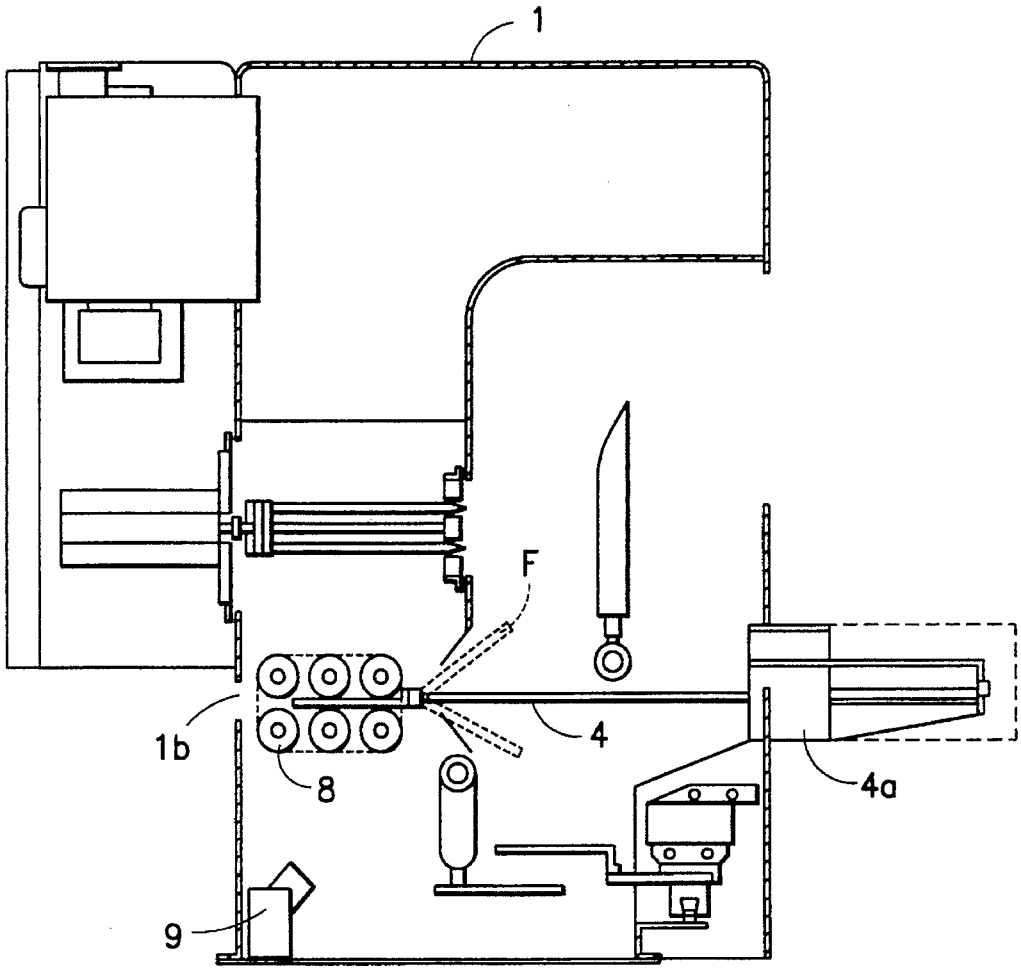
Figure 9B:
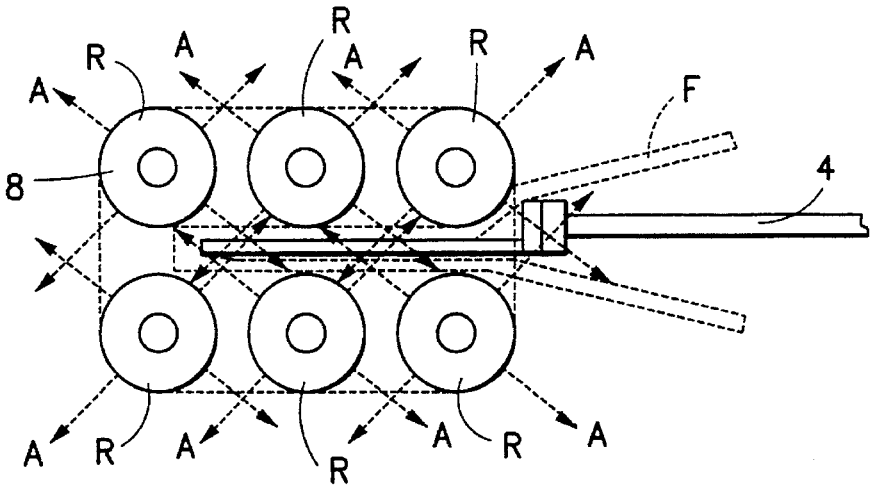

Referring to FIGS. 9*a*, 9*b*, and 10, a bag pusher 4 below drive shaft 3*a* is driven by a bag pusher drive actuator 4*a*. Opposite bag pusher 4, a plurality of pairs of rollers 8 are spaced apart horizontally. A vertical distance between rollers 8 accommodates bag pusher 4 and folded bag F. After bag F is emptied, bag pusher 4 pushes a middle of bag F between rollers 8. Bag F is folded in two as it moves between rollers 8. Bag F is pushed by rollers 8 through a bag discharge opening 1*b*.

Figure 3:
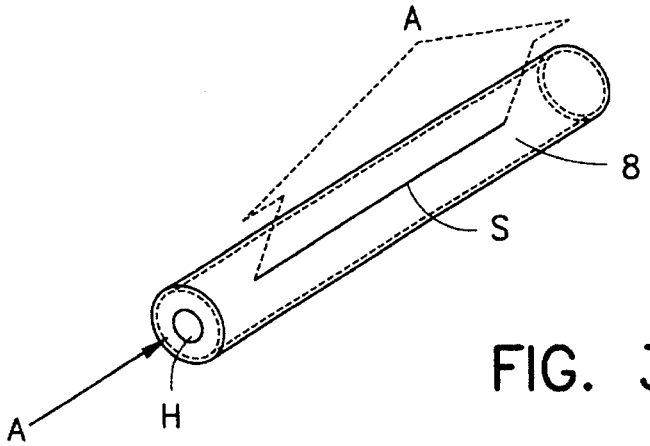
FIG. 3 is a perspective view of a roller used in an embodiment of the present invention.

Referring also to FIG. 3, each roller 8 includes a hole H in one end and a slit S in its outer surface. High-pressure air A enters roller 8 through hole H, and is blown out through slit S, to remove any contents of bag F adhering to the outside of the bag. A relatively clean empty bag F is discharged to the outside.

Figure 4:
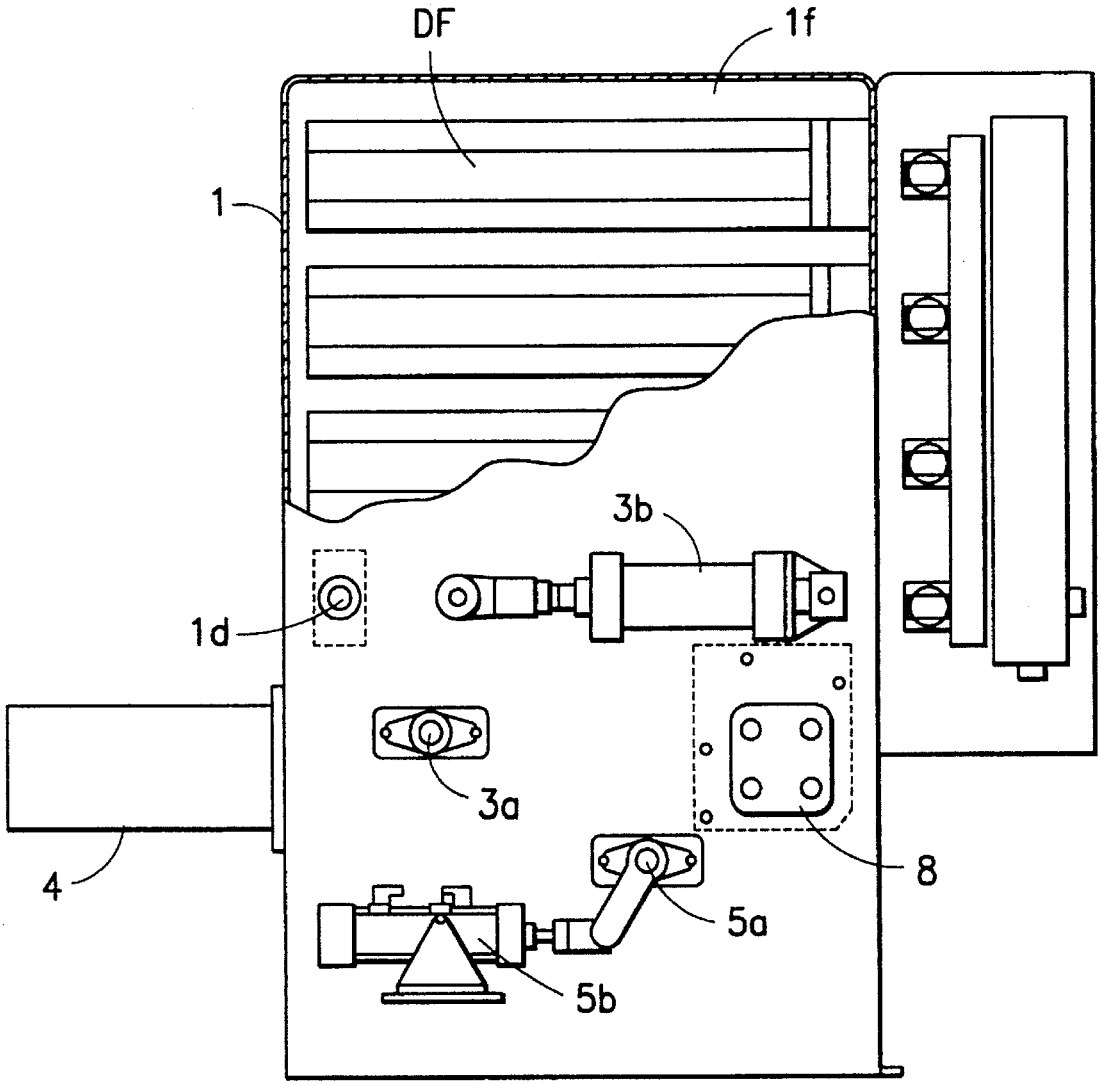
FIG. 4 is a partially cut away back elevation view of the embodiment of FIG. 1.
Figure 5A:
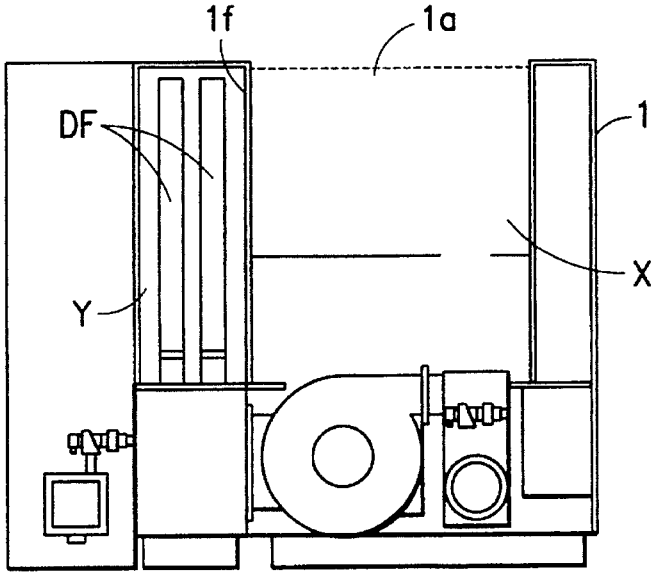
Figure 5B:
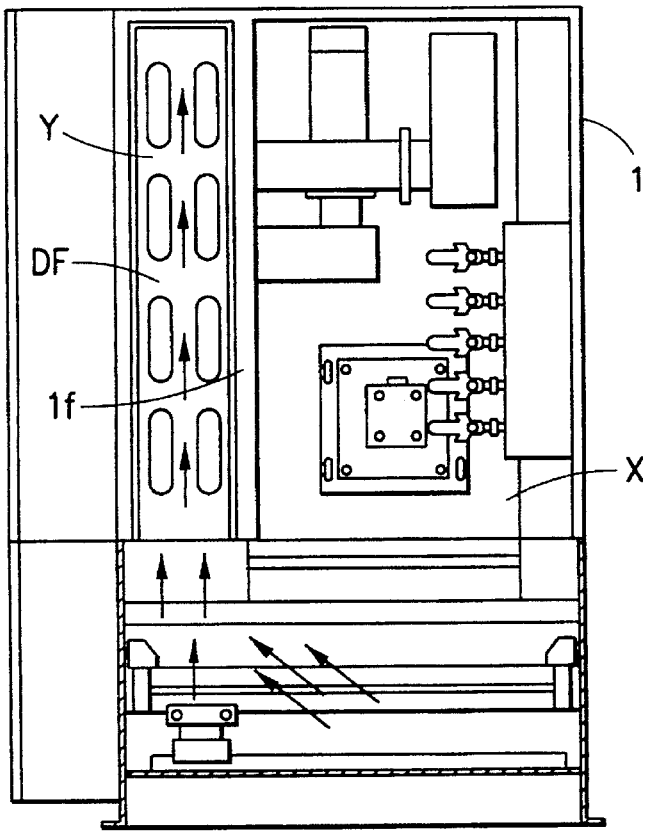

Referring to FIGS. 4, 5*a*, and 5*b*, a back of housing 1 includes a bag assist plate drive actuator 3*b* that drives bag assist plate 3. A bag rest drive actuator 5*b* drives bag rest 5. In addition, housing 1 includes a dust collection treatment chamber Y in the space between a partition wall 1*f* and the back of housing 1. Dust collection treatment chamber Y is separate and independent from a bag treatment chamber X. Dust collection treatment chamber Y includes a dust collector DF. Powder and dust arise from the emptying operation of bag F as described above. The powder and dust mixed in with the contents of bag F are sucked into the dust collector and removed, as shown by the arrows in FIG. 5*b*.

The interior of bag treatment chamber X is maintained at a negative pressure compared to atmospheric pressure. This ensures that dust is prevented from leaving bag treatment chamber.

The automatic bag opening device of this working example accomplishes the following benefits.

(1) Substantial labor savings are made possible because a series of steps are performed automatically according to a prescribed sequence. The steps of introducing a filled bag, opening it, discharging its contents, supplying the contents to a chute or hopper, folding the empty bag, and discharging the used bag outside the device are all automatic.

(2) A significant savings in space is successfully achieved. This makes it easier to transport and install the equipment, which is installed in a small plant despite limited installation space.

(3) An automatic air cleaning device is built into an automatic bag opening device, thus realizing a very hygienic device that solves the problem of miscellaneous germs caused by residual substances inside the device.

(4) Emptied bags are automatically folded and cleaned. Because any substances adhering to the bags are automatically removed by air cleaning during the process, empty bags are recovered easily. in addition, pollution of the surrounding area from dust is completely eliminated.

(5) Installation of separate dust collection equipment is not required since there is a dust collector inside the same housing.

(6) The need for frequent cleaning of the inside of the device is eliminated. An automatic self-cleaning function keeps the inside of the device clean at all times during operation.

(7) Since the dust collector is of the side-attachment type, the suction opening for sucking in powder and dust with negative pressure is placed near the discharge outlet for dust inside the device. This facilitates efficient recovery of powder and dust without waste.

(8) The powdered or granular substances emptied from the bag are completely discharged due to the high-pressure air blowing inside the device.

(9) The various drive functions of the device, such as actuators, motors, piping, and wiring, are all attached on the outside of the unit, thereby making maintenance and inspection very easy.

(10) Using the device improves the workplace environment since the device generates no vibration, noise, or dust during operation.

(11) The mechanisms of this device operate under the control of algorithms that simulate the manual work. Therefore, the contents are treated gently, with no contamination from foreign matter.

Referring to FIGS. 11–13, a second embodiment of the present invention includes a housing 10 with a bag intake opening 10a for receiving a bag F from a transport conveyor 2. When a control circuit (not shown) powers on, the control circuit outputs a drive signal causing a bag assist plate 11 and a bag rest 13 to rotate and stop in a tilted position. When transport conveyor 2 is activated, bag F is transported to housing 10 where it enters through bag intake opening 10*a* as shown by the arrow. Bag F slides down along the tilted bag assist plate 11 to bag rest 13.

Referring to FIG. 14, when the control circuit detects that bag F is stopped by bag assist plate 11 and bag rest 13, it outputs a drive signal returning bag assist plate 11 and bag rest 13 to their vertical states. Bag F assumes an upright state. The control circuit outputs a drive signal to a penetrator drive actuator 14*a*, inserting a tip of a penetrator 14 into an upper part of the upright bag F and holding the bag in place.

Referring to FIG. 15, when the control circuit detects that bag F is completely held by penetrator 14, it outputs a drive signal causing bag rest 13 to rotate to the rear, leaving bag F suspended from penetrator 14. Then the control circuit outputs a drive signal to a bag cutter drive actuator 16*a*, activating a bag cutter 16. Bag cutter 16 cuts open the bottom of bag F to let the contents fall. A high-pressure blast of air from an air nozzle 16*b* strikes bag F as shown by an arrow a. The various powdered or granular substances remaining in bag F are knocked loose. The contents of bag F fall through a chute connection opening 10*c* as shown by arrows b to a chute 10*f* or hopper (not shown).

While subjecting bag F to high-pressure blasts of air to knock out the various powdered or granular substances inside bag F, a dust collector 17, near a ceiling of housing 10, is in operation. The powder and dust mixed in with the various substances knocked off from bag F are sucked in and removed by dust collector 17 as shown by arrows c. Referring to FIGS. 16*a*–16*b*, the control circuit outputs a drive signal to a bag pusher drive actuator 12*a*, moving a bag pusher 12 against the now empty bag F. Bag F is folded in half as bag pusher 12 pushes bag F into a gap between upper and lower rollers R of a roller assembly 15. A pair of rollers R closest to bag pusher 12 are spaced apart sufficient for bag pusher 12 to pass between as it pushes bag F. A pair of rollers R furthest away from bag pusher 12 are spaced apart sufficient for only folded bag F to pass between. Rollers R rotate while high-pressure blasts of air A are released from slits (not shown) in an outer surface of rollers R. Bag F is cleaned by the high-pressure blasts of air A while being folded in half by the gap portion of the upper and lower rollers 15.

Referring to FIG. 17, the now emptied and cleaned bag F is discharged outside housing 10 from a bag discharge opening 10*b*. Bag pusher 12 is retracted by bag pusher drive actuator 12*a*. The automatic bag opening device is now ready for another bag.

Referring to FIG. 18, an alternative embodiment uses a bag suspension holding claw 18 to hold bag F in place during the cutting and air-blasting operations. A linear actuator 19 moves bag suspension holding claw 18 up and down, as shown by an arrow d, or left and right, as shown by an arrow e. A penetrator is not used in this embodiment. Blasts of air from air nozzle 9 shake bag F while the contents of the bag fall into a chute 20. The remainder of the operation is as described in the previous embodiments, so further description is therefore omitted.

Referring to FIG. 19, a third embodiment of the present invention is similar to the first embodiment. Therefore, only the differences are discussed here. A plurality of hollow penetrators 7' include a plurality of spaced apart holes 21. After penetration of a filled bag (not shown), at least one hole 21 in each penetrator 7' preferably remains outside the bag. A bag assist plate 3' includes a plurality of recesses 3*c* horizontally aligned with penetrators 7'. Penetrators 7', after penetrating the bag, engage in recesses 3*c* to support the bag after bag rest 5 rotates from under the bag. After the bottom of the bag is cut by bag cutter 6, air blasts through holes 21 in penetrators 7' strike the inside and outside of the bag, thereby ensuring that all the contents of the bag are knocked loose. Since air blasts strike the outside of the bag from at least one hole 21, air nozzle 9 shown in previous embodiments is not required.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An automatic bag opening device for opening and emptying a bag of its contents, comprising:

a housing;

a bag intake opening in said housing;

a bag assist plate in said housing;

first means for moving said bag assist plate between an upright position and a chute position;

a bag rest;

second means for moving said bag rest between a release position to supporting position;

means for coordinating movement of said bag assist plate to said chute position while moving said bag rest to said supporting position;

a hollow penetrator;

means for extending said penetrator into a bag supported on said bag rest;

means, operative after penetration by said penetrator, for slitting a bottom of said bag;

means for rotating said bag rest away from said bag bottom while said bag is supported by said penetrator whereby exit of a content of said bag is enabled;

means for blowing air through said penetrator into said bag, whereby said exit is hastened;

means for striking an exterior of said bag with at least one blast of air, thereby assisting said contents of said bag to fall out;

a bag discharge opening in a wall of said housing;

at least first and second rollers with a gap therebetween, said gap adjacent to said bag discharge opening;

said rollers having at least one slit therein;

means for blowing air through said slits;

a bag pusher attached to said housing opposite said gap; and means for extending and retracting said bag pusher to fold and push a portion of an empty bag into said gap so that said empty bag is discharged through said bag discharge opening.

2. A device according to claim 1, further comprising:

means for transporting said bag to said bag intake opening; and a dust collector in said housing.

3. An automatic bag opening device for opening and emptying a bag of its contents, comprising:

a housing;

a bag intake opening in said housing;

a bag assist plate with first and second ends;

said bag assist plate first end being rotatably mounted on a shaft connected to said housing;

said bag assist plate second end rotating from an upright position to a chute position near said bag intake opening;

an "L"-shaped bag rest having first and second portions;

a first end of said first portion being rotatably mounted on a shaft connected to said housing;

a second end of said first portion perpendicularly attached to a first end of said second portion;

means for rotating said bag rest and said bag assist plate in tandem, whereby said second portion of said bag rest remains substantially perpendicular to said bag assist plate before, during, and after rotation;

a plurality of hollow penetrators;

each of said penetrators having a tip with an opening therein;

a plurality of recesses in said bag assist plate corresponding in number and position to a number and position of said penetrators;

means for extending and retracting said penetrators into and out of said recesses;

means for blowing air through said tips of said penetrators;

means, operative after said means for extending said penetrators, for cutting a bottom of said bag when said bag is on said bag rest and said bag assist plate is in said upright position;

means for rotating said bag rest away from said bag bottom independently of said bag assist plate;

means for striking said bag with at least one blast of air, thereby assisting said contents of said bag to fall out;

a bag discharge opening in a wall of said housing;

at least first and second rollers with a gap therebetween, said gap adjacent to said bag discharge opening;

said rollers having at least one slit therein;

means for blowing air through said slits;

a bag pusher attached to said housing opposite said gap; and means for extending and retracting said bag pusher whereby an empty bag is pushed into said gap and discharged through said bag discharge opening.

4. A device according to claim 3, further comprising:

means for transporting said bag to said bag intake opening; and a dust collector in said housing.

5. An automatic bag opening device for opening and emptying a bag of its contents, comprising:

a housing;

a bag intake opening in said housing;

a bag assist plate with first and second ends;

said bag assist plate first end being rotatably mounted on a shaft connected to said housing;

said bag assist plate second end rotating from an upright position to a chute position near said bag intake opening;

an "L"-shaped bag rest having first and second portions;

a first end of said first portion being rotatably mounted on a shaft connected to said housing;

a second end of said first portion perpendicularly attached to a first end of said second portion;

means for rotating said bag rest and said bag assist plate in tandem, whereby said second portion of said bag rest remains substantially perpendicular to said bag assist plate before, during, and after rotation;

a bag suspension holding claw in said housing;

means for moving said holding claw horizontally and vertically;

means for opening and closing said holding claw, thereby permitting said bag to be held in a held state;

means for cutting a bottom of said bag when said bag is in said held state;

means for rotating said bag rest away from the bag bottom independently of said bag assist plate;

means for striking said bag with at least one blast of air, thereby assisting said contents of said bag to fall out;

a bag discharge opening in a wall of said housing;

at least first and second rollers with a gap therebetween, said gap adjacent to said bag discharge opening;

said rollers having at least one slit therein;

means for blowing air through said slits;

a bag pusher attached to said housing opposite said gap; and means for extending and retracting said bag pusher whereby an empty bag is pushed into said gap and discharged through said bag discharge opening.

6. A device according to claim 5, further comprising:

means for transporting said bag to said bag intake opening; and a dust collector in said housing.

* * * * *